US010360891B2

(12) United States Patent
Christoph et al.

(10) Patent No.: US 10,360,891 B2
(45) Date of Patent: Jul. 23, 2019

(54) WIRELESS NOISE AND VIBRATION SENSING

(71) Applicant: HARMAN BECKER AUTOMOTIVE SYSTEMS GMBH, Karlsbad (DE)

(72) Inventors: Markus Christoph, Straubing (DE); Gerhard Pfaffinger, Regensburg (DE); Nikos Zafeiropoulos, Straubing (DE)

(73) Assignee: HARMAN BECKER AUTOMOTIVE SYSTEMS GMBH, Karlsbad (DE)

( * ) Notice: Subject to any disclaimer, the term of this patent is extended or adjusted under 35 U.S.C. 154(b) by 322 days.

(21) Appl. No.: 15/266,685

(22) Filed: Sep. 15, 2016

(65) Prior Publication Data

US 2017/0076711 A1 Mar. 16, 2017

(30) Foreign Application Priority Data

Sep. 15, 2015 (EP) ..... 15185235

(51) Int. Cl.
*G10K 11/178* (2006.01)

(52) U.S. Cl.
CPC ..... *G10K 11/178* (2013.01); *G10K 2210/129* (2013.01); *G10K 2210/1282* (2013.01);
(Continued)

(58) Field of Classification Search
CPC .... B60T 2240/03; B60T 8/1725; B60T 8/175; B60T 8/171; G10K 11/178
See application file for complete search history.

(56) References Cited

U.S. PATENT DOCUMENTS

2002/0177942 A1* 11/2002 Knaian ..... G08G 1/02 701/117
2008/0177447 A1* 7/2008 Hsiang ..... B60R 25/102 701/45

(Continued)

FOREIGN PATENT DOCUMENTS

EP 2508364 A1 * 10/2012 ..... B60C 23/0413
EP 2508364 A1 * 10/2012 ..... B60C 23/0413
WO 2012162241 A2 11/2012

OTHER PUBLICATIONS

European Search Report for corresponding Application No. 15185235.7, dated Mar. 16, 2016, 7 pages.

*Primary Examiner* — Akelaw Teshale
(74) *Attorney, Agent, or Firm* — Brooks Kushman P.C.

(57) ABSTRACT

A noise and vibration measurement arrangement, system, and method are disclosed. The arrangement is configured to operate with an active road noise control system. The arrangement includes an energy harvester, an acceleration sensor, a signal processor, and a signal transmitter. The energy harvester obtains electrical energy from an ambient energy source. The acceleration sensor is configured to generate a sense signal. The signal processor is configured to provide a processed sense signal. The signal processor includes a normal mode of operation and an energy saving mode of operation. The signal transmitter includes a normal mode of operation and an energy saving mode. The energy controller evaluates the electrical energy from the energy harvester to operate in the energy saving mode when the electrical energy is below a predetermined energy level and to operate in the normal mode when the electrical energy is above the predetermined energy level.

20 Claims, 5 Drawing Sheets

(52) U.S. Cl.
CPC ..... *G10K 2210/12821* (2013.01); *G10K 2210/3016* (2013.01); *G10K 2210/3027* (2013.01); *G10K 2210/3221* (2013.01); *G10K 2210/501* (2013.01)

(56) References Cited

U.S. PATENT DOCUMENTS

| | | | | |
|---|---|---|---|---|
| 2010/0271199 | A1* | 10/2010 | Belov | G01M 5/00 340/539.3 |
| 2010/0294032 | A1* | 11/2010 | Pannek | B60T 8/1725 73/146 |
| 2012/0070012 | A1 | 3/2012 | Yoshizawa et al. | |
| 2012/0089299 | A1* | 4/2012 | Breed | B60C 11/24 701/36 |
| 2012/0239268 | A1* | 9/2012 | Chen | B60W 30/146 701/96 |

* cited by examiner

WIRELESS NOISE AND VIBRATION SENSING

CROSS-REFERENCE TO RELATED APPLICATIONS

This application claims priority to EP application Serial No. 15185235.7 filed Sep. 15, 2015, the disclosure of which is hereby incorporated in its entirety by reference herein.

TECHNICAL FIELD

The disclosure relates to wireless noise and vibration sensor arrangements for road noise control systems, road noise control systems and wireless noise and vibration sensing methods.

BACKGROUND

Land based vehicles, when driven on roads and other surfaces, generate low frequency noise known as road noise. Even in modern vehicles, cabin occupants may be exposed to road noise that is transmitted through the structure, e.g., tires-suspension-body-cabin path, and through airborne paths, e.g. tires-body-cabin path, to the cabin. It is desirable to reduce the road noise experienced by cabin occupants. Active Noise, vibration, and harshness (NVH) control technologies, also known as active road noise control (RNC) systems, can be used to reduce these noise components without modifying the vehicle's structure as in active vibration technologies. However, active sound technologies for road noise cancellation may require very specific noise and vibration (N&V) sensor arrangements throughout the vehicle structure in order to observe road noise related noise and vibration signals.

SUMMARY

An example noise and vibration sensor arrangement, which is configured to operate with an active road noise control system, includes an energy harvester configured to obtain electrical energy from an ambient energy source; an acceleration sensor supplied with electrical energy from the energy harvester and configured to generate a sense signal representative of at least one of accelerations, motions and vibrations that act on the acceleration sensor. The sensor arrangement further includes a signal processor supplied with electrical energy from the energy harvester and configured to process the sense signal and to provide a processed sense signal. The signal processor having a normal mode of operation with a first energy consumption and an energy saving mode of operation with a second energy consumption that is lower than the first energy consumption. The arrangement further includes a signal transmitter supplied with electrical energy from the energy harvester and configured to wirelessly broadcast the processed sense signal, the signal transmitter having a normal mode of operation with a third energy consumption. The arrangement further includes an energy saving mode of operation with a fourth energy consumption that is lower than the third energy consumption. The arrangement further includes an energy controller configured to evaluate the electrical energy from the energy harvester and to control at least one of the signal processor and signal transmitter to operate in the energy saving mode when the electrical energy from the harvester is below a predetermined energy level and to otherwise operate in the normal mode.

An example active road noise control system includes a noise and vibration sensor arrangement, an active road noise control module and at least one loudspeaker.

An example noise and vibration measurement method, which is configured to operate with an active road noise control system, includes obtaining electrical energy from an ambient energy source; supplying an acceleration sensor with electrical energy from the energy harvester; generating with the acceleration sensor a sense signal representative of at least one of accelerations, motions and vibrations that act on the acceleration sensor; supplying a signal processor with electrical energy from the energy harvester, the signal processor having a normal mode of operation with a first energy consumption and an energy saving mode of operation with a second energy consumption that is lower than the first energy consumption; and processing the sense signal to provide a processed sense signal. The method further includes supplying a signal transmitter with electrical energy from the energy harvester. The signal transmitter includes a normal mode of operation with a third energy consumption and an energy saving mode of operation with a fourth energy consumption that is lower than the third energy consumption. The method further includes wirelessly broadcasting the sense signal via the signal transmitter; evaluating the electrical energy obtained from the ambient energy source; and controlling at least one of the signal processor and/or signal transmitter to operate in the energy saving mode when the electrical energy from the harvester is below a predetermined energy level and to otherwise operate in the normal mode.

BRIEF DESCRIPTION OF THE DRAWINGS

The disclosure may be better understood by reading the following description of non-limiting embodiments to the attached drawings, in which like elements are referred to with like reference numbers, wherein below.

DETAILED DESCRIPTION

Noise and vibration sensors provide reference inputs to active RNC systems, e.g., multichannel feedforward active road noise control systems, as a basis for generating the anti-noise that reduces or cancels road noise. Noise and vibration sensors may include acceleration sensors such as accelerometers, force gauges, load cells, etc. For example, an accelerometer is a device that measures proper acceleration. Proper acceleration is not the same as coordinate acceleration, which is the rate of change of velocity. Single- and multi-axis models of accelerometers are available for detecting magnitude and direction of the proper acceleration, and can be used to sense orientation, coordinate acceleration, motion, vibration, and shock.

Airborne and structure-borne noise sources are monitored by the noise and vibration sensors in order to provide the highest possible road noise reduction (cancellation) performance between 0 Hz and 1 kHz. For example, acceleration sensors used as input noise and vibration sensors may be disposed across the vehicle to monitor the structural behavior of the suspension and other axle components for global RNC. Above a frequency range that stretches from 0 Hz to approximately 500 Hz, acoustic sensors that measure the airborne road noise may be used as reference control inputs. Furthermore, two microphones may be placed in the headrest in close proximity of the passenger's ears to provide an error signal or error signals in case of binaural reduction or cancellation. The feedforward filters are tuned or adapted to achieve maximum noise reduction or noise cancellation at both ears.

Figure 1:
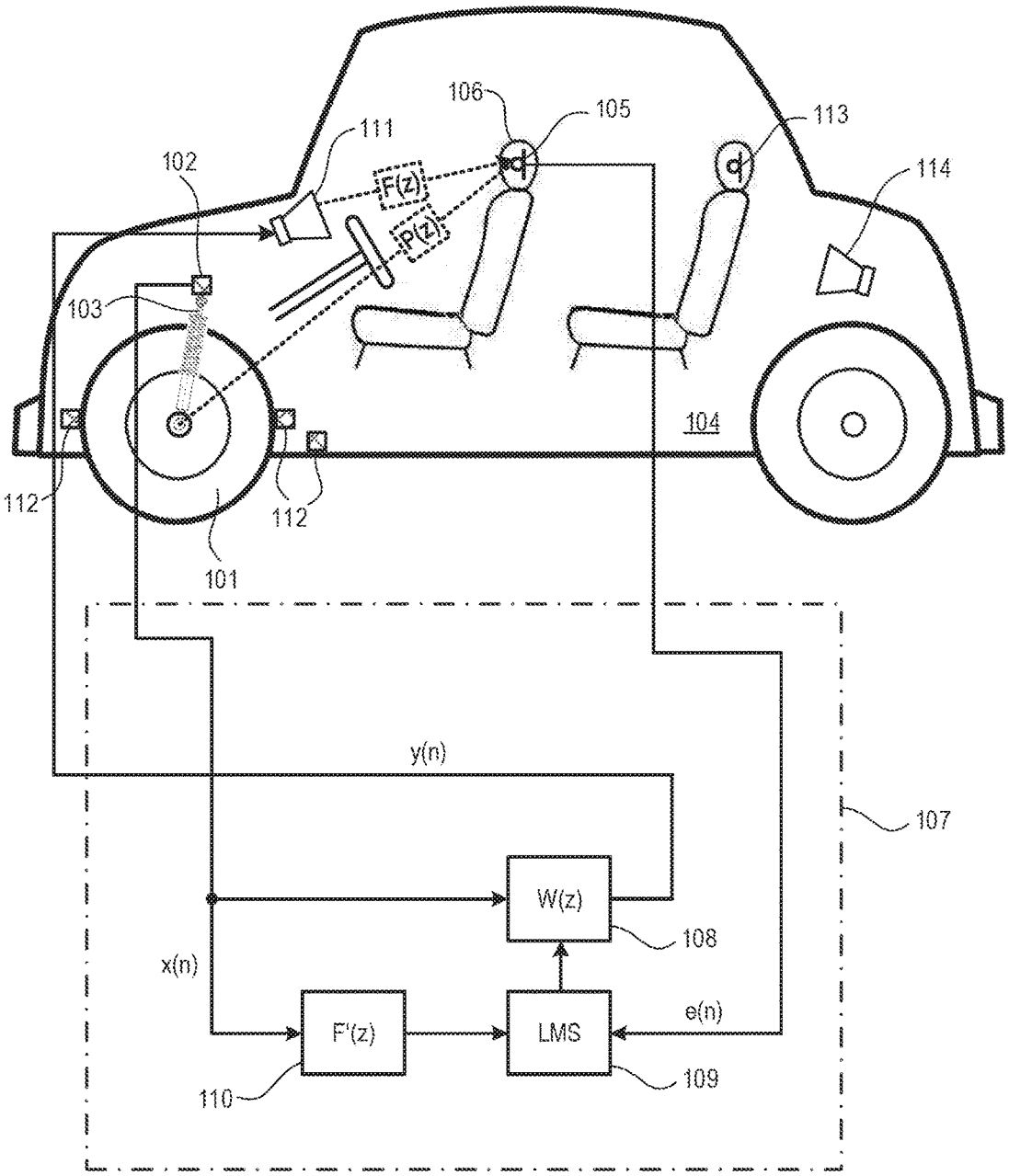
FIG. 1 is a schematic diagram illustrating an exemplary simple single-channel active road noise control system.

A simple single-channel feedforward active RNC system may be constructed as shown in FIG. 1. Vibrations that originate from a wheel 101 moving on a road surface are detected by a suspension acceleration sensor 102 which is mechanically coupled with a suspension device 103 of an automotive vehicle 104 and which outputs a noise and vibration signal x(n) that represents the detected vibrations and, thus, correlates with the road noise audible within the cabin. At the same time, an error signal e(n) representing noise present in the cabin of the vehicle 104 is detected by a microphone 105 arranged within the cabin in a headrest 106 of a seat (e.g., the driver's seat). The road noise originating from the wheel 101 is mechanically transferred to the microphone 105 according to a transfer characteristic P(z).

A transfer characteristic W(z) of a controllable filter 108 is controlled by an adaptive filter controller 109 which may operate according to the known least mean square (LMS) algorithm based on the error signal e(n) and on the road noise signal x(n) filtered with a transfer characteristic F'(z) by a filter 110, wherein $W(z)=-P(z)/F(z)$. $F'(z)=F(z)$ and F(z) represents the transfer function between a loudspeaker and the microphone 105. A signal y(n) having a waveform inverse in phase to that of the road noise audible within the cabin is generated by an adaptive filter formed by controllable filter 108 and filter controller 109, based on the thus identified transfer characteristic W(z) and the noise and vibration signal x(n). From signal y(n) a waveform inverse in phase to that of the road noise audible within the cabin is then generated by the loudspeaker 111, which may be arranged in the cabin, to thereby reduce the road noise within the cabin. The exemplary system described above employs a straightforward single-channel feedforward filtered-x LMS control structure 107 for the sake of simplicity, but other control structures, e.g., multi-channel structures with a multiplicity of additional channels, a multiplicity of additional noise sensors 112, a multiplicity of additional microphones 113, and a multiplicity of additional loudspeakers 114, may be applied as well.

Figure 2:
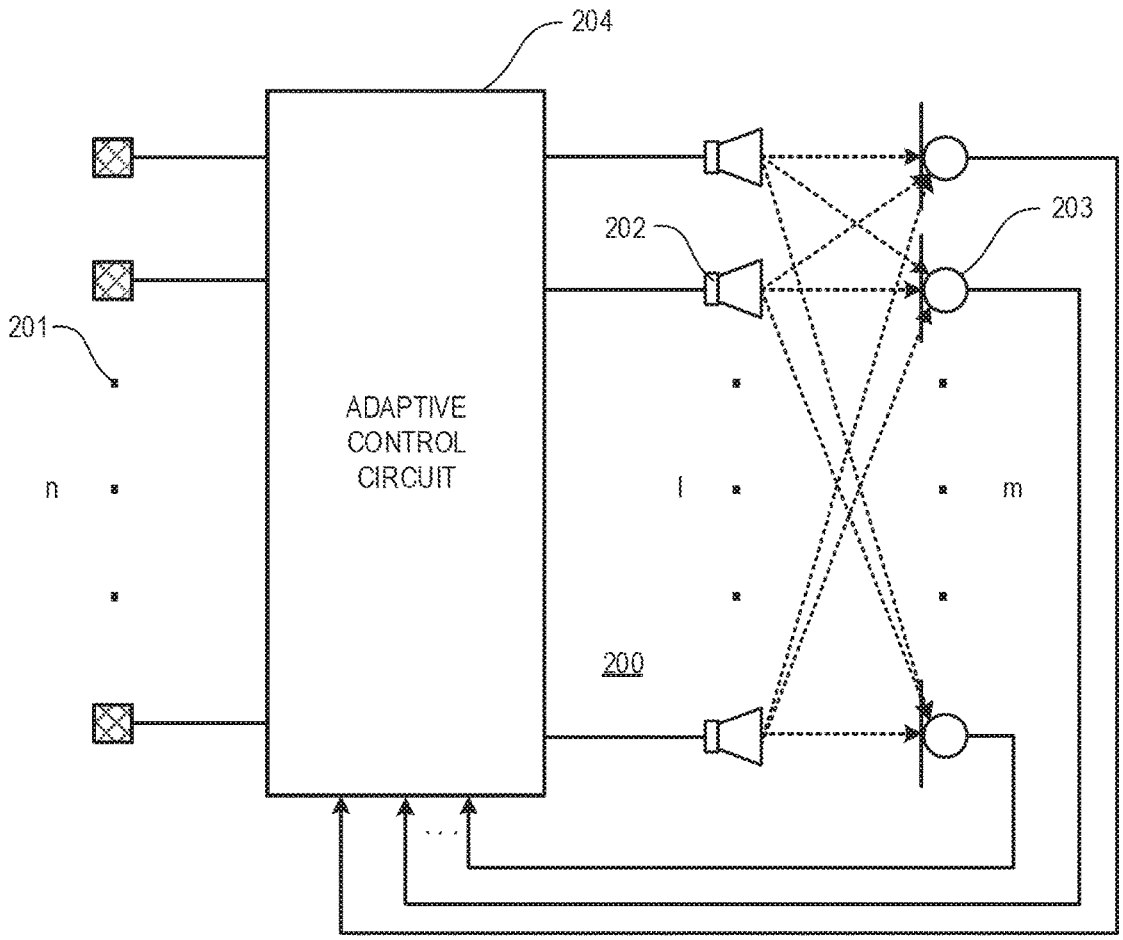
FIG. 2 is a schematic diagram illustrating an exemplary simple multi-channel active road noise control system.

FIG. 2 shows an active road noise control system 200 which is a multi-channel type active road noise control system capable of suppressing noise from a plurality of noise and vibration sources. The active road noise control system 200 comprises a multiplicity n of noise and vibration sensors 201, a multiplicity 1 of loudspeakers 202, a multiplicity m of microphones 203, and an adaptive control circuit 204 which operates to minimize the error between noise from the noise and vibration sources (primary noise) and cancelling noise (secondary noise). The adaptive control circuit 204 may include a number of control circuits provided for each of the loudspeakers 202, which create cancelling signals for cancelling noise from corresponding noise and vibration sources.

In conventional active RNC systems, a major cost factor in connection with sensors in car environments is the sensor wiring. Self-sustaining wireless sensors that use energy-harvest technologies are able to avoid such costs, but are difficult to handle when it comes to reliability. Taking acceleration sensors (accelerometers) as an example, such sensors only need to operate if the car is moving and if sufficient kinetic energy is available, allowing a self-powering of the sensors. At first glance this seems to be a good solution, but situations may also occur, such as cruising over smooth asphalt, in which the energy harvest may not generate sufficient energy to maintain a reliable operation of the sensor, which will be the case if a sensor part, optional signal processing part, and/or data transmission part of a sensor arrangement are operative. If such a situation occurs, where not enough energy is available, it must be avoided that the sensor stops transmitting data, otherwise the whole system is likely to fail.

Figure 3:
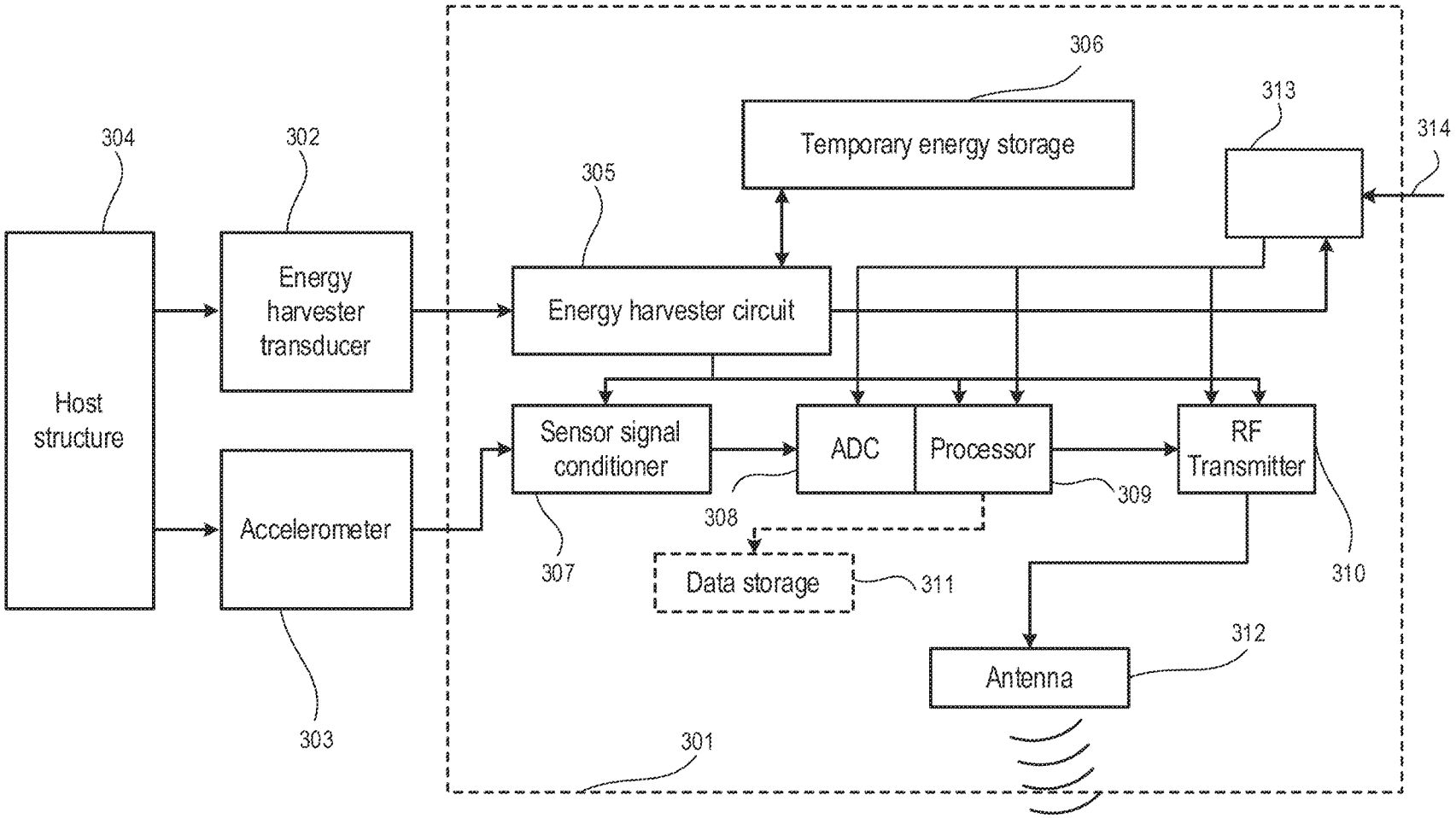
FIG. 3 is a schematic diagram illustrating a noise and vibration sensor arrangement applicable in the systems shown in FIGS. 1 and 2.

Referring now to FIG. 3, an example self-sustaining wireless noise and vibration sensor arrangement may include a circuit arrangement 301 electrically coupled with an energy harvester transducer 302 and an acceleration sensor 303, which are both mechanically coupled with a host structure 304. The electrical circuit arrangement 301 in the sensor arrangement may include an energy harvester circuit 305, temporary energy storage 306, sense signal conditioner 307, analog-to-digital converter (ADC) 308, controller 309, and a radio frequency transmitter 310. Sensor conditioner 307 and processor 309 form a basic signal processor that can be fully analog, fully digital or combined analog and digital (e.g., in combination with analog-to-digital converter 308 as shown). The circuit arrangement 301 may, in some aspects, also include the acceleration sensor 303, such as a microelectromechanical system (MEMS) accelerometer, data storage 311, and an antenna 312.

In the energy harvester circuit 305, electrical energy derived by the electromechanical energy harvester transducer 302 from kinetic energy acting on the transducer 302 is conditioned using an electrical circuit which may include a diode bridge, filter capacitor, over voltage protection, and DC-DC step up or down converter, a voltage regulator, and an output switch. The energy conditioning may provide rectification of a periodic bi-polar voltage waveform from the energy harvester transducer so that a uni-polar waveform can be harvested. The uni-polar, but often period rectified, waveform is fed to one or more input capacitors that act as a voltage filter so that a more steady DC voltage is available for further input voltage conditioning such as DC-DC conversion. The input voltage conditioner may also include a DC to DC voltage step-up or step-down so that the voltage at the filter capacitor can be maintained at an optimal voltage that provides an electrical impedance match with the energy harvester transducer but is also higher or lower than the target energy storage voltage level that may be inherent to the temporary energy storage. The input voltage conditioner may also include input voltage protection to ensure that the diode rectifier and input filter capacitor are not damaged from high voltages that the energy harvester transducer may supply under certain extraneous circumstances.

The temporary energy storage 306, which is operatively connected to the energy harvester circuit 305, may also include a voltage protection feature such as a Zener diode or voltage comparator with a resistive dissipation element to protect the temporary energy storage 306 in the case when it is at its upper energy storage limit and the input energy exceeds the output energy of the temporary energy storage 306. The temporary energy storage 306 provides an energy reservoir so that an electrical load can draw power that is much higher than that supplied by the harvester for short durations. This is needed because the electrical load is generally determined by its specific application and it is often much higher than that which is available directly from the energy harvester transducer 302. However, these loads are typically required for a brief period of time, which allows for a duty cycle operation that balances the harvester-load energy budget. The load can either be connected directly with the energy reservoir or an additional output voltage regulator can be used between the reservoir and the load. This is necessary for many applications because the energy reservoir voltage often fluctuates with the amount of energy stored while the load requires an input voltage that is fixed. In addition to the regulator, a hysteretic power supply switch may provide conductivity from the temporary energy storage 306 or voltage regulator to an electrical load which may include the signal conditioner 307, processor 309, and radio frequency transmitter 310.

The sense signal conditioner 307 may include voltage regulators including linear regulators, operational amplifiers, and analog filter circuitry. The analog filters may serve as a frequency band pass filter with one or more poles. The filter is designed to pass a high fidelity signal for frequencies that correspond to the analog-to-digital converter sampling rate. The sense signal conditioner 307 is powered by the energy harvester circuit 305 and is in communication with the analog-to-digital converter 308. Alternatively, a digital MEMS acceleration sensor may be used which includes analog-to-digital conversion and signal conditioning in one integrated circuit. In this case the digital accelerometer may be wired directly to the controller through a communication bus.

Furthermore, the analog-to-digital converter 308 may be a part of the processor 309 or it can be a separate subsystem of the circuit arrangement 301. The processor 309 may include or may be included in a microprocessor, microcontroller, digital signal processor or any other logic circuitry. In cases when the sampling rate for the accelerometer is high and the sampling duration is long, the optional supplementary data storage 311 in communication with the processor 309 may be employed. The data storage 311 may be a type of flash memory (non-volatile computer storage). A portion of the firmware code in the processor 309, the radio frequency transmitter 310, and the antenna 312 comprise the wireless communication part of the sensor arrangement. The wireless communication supplies data from the processor to a remote wireless data aggregator. When bi-directional communication is provided, it also may serve as a means to maintain remote control and monitoring of the sensor arrangement. The radio frequency transmitter 310 is connected to an antenna which is used to optimally project and receive radio frequency signals. The antenna may be designed as a subsystem of the circuit arrangement 301 or as a separate element. The antenna may be a patch, chip, or PCB antenna. The antenna may be located near the exterior of the sensor and at the greatest distance away from the large metal objects of the sensor arrangement.

Some key requirements for the wireless operation of the sensor are high data throughput rate, rapid response, robust data transmission, high level of data integrity, multi-node networking, and low power usage. Higher frequency bands exhibit moderate to high data throughput to support high sensor sampling rates and good transmission performance over short distances (10-100 m). The frequency of these bands also favors small devices because antenna size scales roughly inversely with frequency for a given performance level. Approaches for maximizing communication robustness in the presence of inter-network traffic and external wireless interference may take advantage of short turn-on times, high data rate, and ultra-low power acknowledgment to enable robustness purely through rapid and repetitive retransmissions.

In order to minimize the sensor size and weight, the total system energy budget is minimized at all levels including the acceleration measurement. MEMS accelerometers can be implemented to exhibit ultra-low power operation; however, the current commercially available acceleration sensors have limited bandwidth and noise floor which precludes uses for applications, requiring high fidelity measurement as for RNC systems. Piezoelectric accelerometers are capable of performing wide bandwidth and high resolution measurements. However, acceleration measurement using traditional piezoelectric accelerometers can consume significant power and therefore the particular implementation of the sensor is important. Integrated charge amplifiers are generally used with piezoelectric accelerometers because they enable the use of long wire connections between the accelerometer and the data acquisition system that are protected to some degree from external EMI. In wireless accelerometers, the wire length from the piezoelectric element to the microprocessor analog to digital converter can be short and therefore the integrated charge amplifier can be eliminated or redesigned for low power operation. To shorten the wire length, the piezoelectric accelerometer and the circuit should be located adjacent to one another. Simple signal conditioning including filters and amplifiers can be implemented on the circuit board instead of using a piezoelectric accelerometer integrated charge amplifier.

Even if all measures have been taken to reduce the basic energy consumption of the sensor arrangement, there is still some risk involved that the sensor arrangement will not be supplied with enough energy to ensure the proper functioning of the sensor arrangement. In order to reduce this risk, at least one of the signal processor (e.g., processor 309 and eventually analog-to-digital converter 308 shown in FIG. 3), and the signal transmitter (e.g., radio frequency transmitter 310 shown in FIG. 3) may process and/or transmit digital signals at a data rate in the energy saving mode that is reduced compared to the normal mode. An energy controller 313 may evaluate the electrical energy supplied by the energy harvester circuit 305 in connection with the energy harvester transducer 302 and may control at least one of the analog-to-digital converter 308, processor 309 and signal transmitter 310 to operate in the energy saving mode when the available electrical energy from the harvester circuit 305 is below a predetermined energy level 314 and to otherwise operate in the normal mode. The available energy may be evaluated, for example, by examining the effective value of the supply voltage output by the harvester circuit 305, voltage drops of its supply voltage, the energy stored in the temporary energy storage 306 etc.

Figure 4:
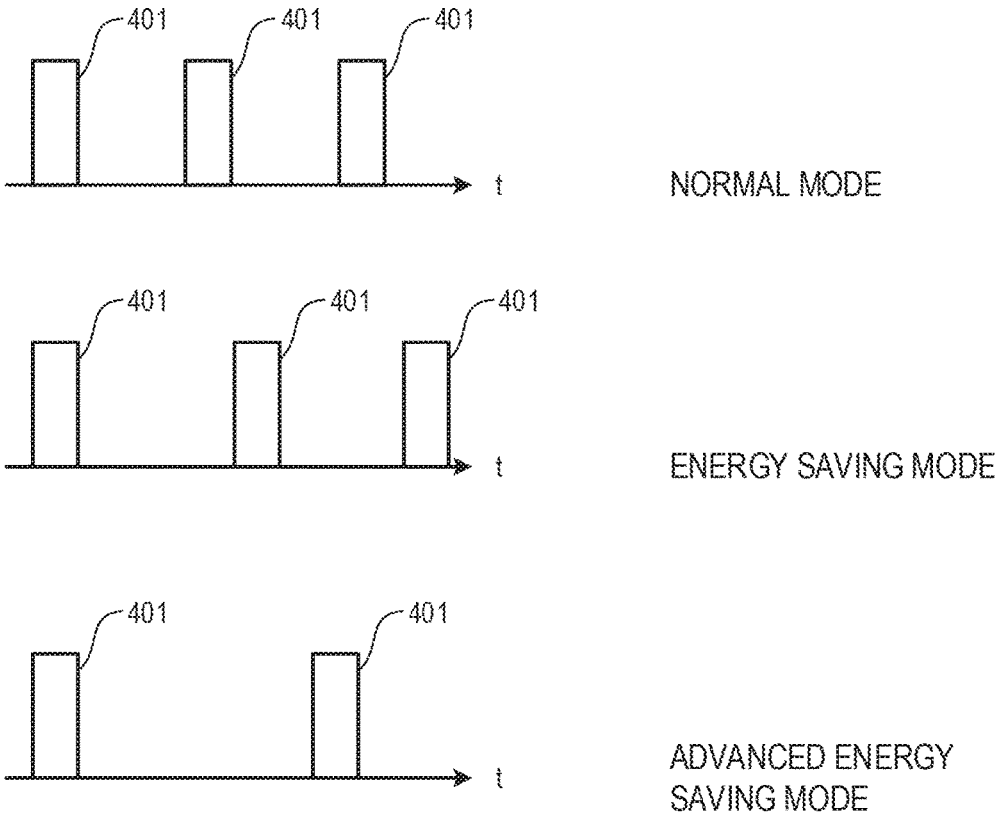
FIG. 4 is a schematic diagram illustrating a mode-dependent sample rate reduction.
Figure 5:
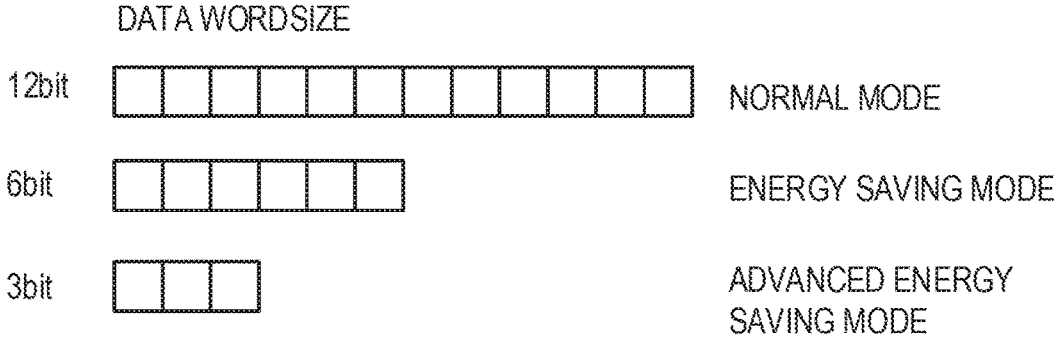
FIG. 5 is a schematic diagram illustrating a mode-dependent word size reduction.
Figure 6:
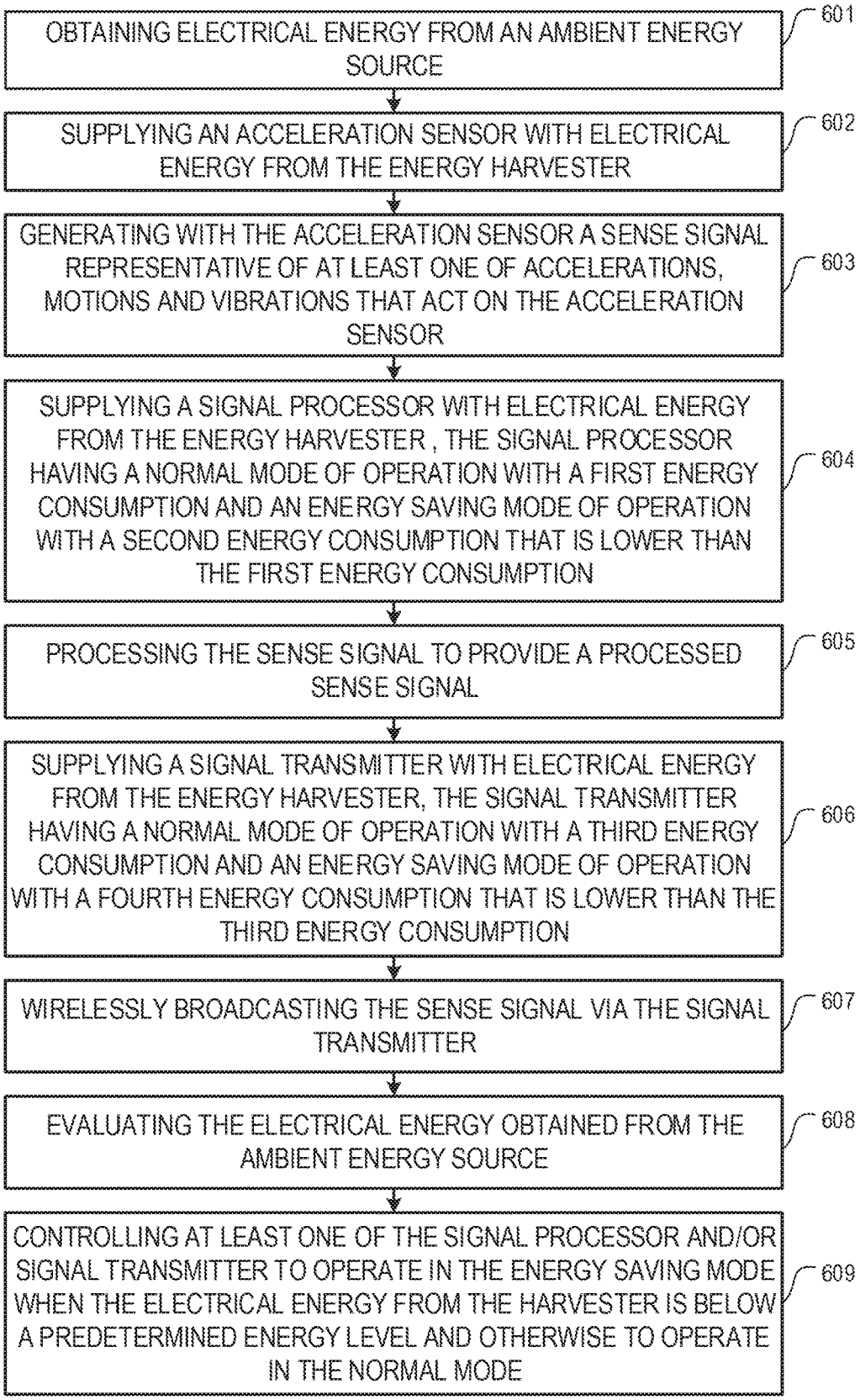
FIG. 6 is a flow chart illustrating an example noise and vibration sensing method.

A reduced data rate may be achieved by at least one of reducing the sampling rate and reducing the word size of the data to be processed and/or transmitted. FIG. 4 illustrates the reduction of the sampling rate which has the effect that, on the one hand, less samples 401 per time t are processed and/or transmitted in the energy saving mode; however, the frequency range of the signals to be processed and/or transmitted is also reduced. Therefore, the sampling rate cannot not be reduced to any desired rate without deteriorating the signal quality significantly. Additionally or alternatively, the word size of the data, i.e., of its samples, may be reduced as shown in FIG. 5. For example, a 12 bit sample in the normal mode may be reduced to 6 bit sample in the energy saving mode.

As can be seen in FIGS. 4 and 5, an advanced energy saving mode may be employed when the available electrical energy is below a further predetermined energy level which is below the predetermined energy level 314. In the advanced energy saving mode, the sample rate is further reduce to, for example, 50% of that used in the normal mode and/or the word size may be reduced to, for example, 3 bit. Nevertheless, the data flow will not be interrupted, which is important for the proper operation of the sensor arrangement.

An example noise and vibration sensing method may include obtaining electrical energy from an ambient energy source (601); supplying an acceleration sensor with electrical energy from the energy harvester (602); and generating with the acceleration sensor a sense signal representative of at least one of accelerations, motions and vibrations that act on the acceleration sensor (603). The method further includes supplying a signal processor with electrical energy from the energy harvester (604), wherein the signal processor has a normal mode of operation with a first energy consumption and an energy saving mode of operation with a second energy consumption that is lower than the first energy consumption, and processing the sense signal to provide a processed sense signal (605). The method further includes supplying a signal transmitter with electrical energy from the energy harvester (606), wherein the signal transmitter has a normal mode of operation with a third energy consumption and an energy saving mode of operation with a fourth energy consumption that is lower than the third energy consumption, wirelessly broadcasting the sense signal via the signal transmitter (607), and evaluating the electrical energy obtained from the ambient energy source (608). At least one of the signal processor and/or signal transmitter operate in the energy saving mode when the electrical energy from the harvester is below a predetermined energy level and otherwise operate in the normal mode (609).

The description of embodiments has been presented for purposes of illustration and description. Suitable modifications and variations to the embodiments may be performed in light of the above description or may be acquired by practicing the methods. For example, unless otherwise noted, one or more of the described methods may be performed by a suitable device and/or combination of devices. The described methods and associated actions may also be performed in various orders in addition to the order described in this application, in parallel, and/or simultaneously. The described systems are exemplary in nature, and may include additional elements and/or omit elements.

As used in this application, an element or step recited in the singular and proceeded with the word "a" or "an" should be understood as not excluding the plural of said elements or steps, unless such exclusion is stated. Furthermore, references to "one embodiment" or "one example" of the present disclosure are not intended to be interpreted as excluding the existence of additional embodiments that also incorporate the recited features. The terms "first," "second," and "third," etc. are used merely as labels, and are not intended to impose numerical requirements or a particular positional order on their objects. The following claims particularly point out subject matter from the above disclosure that is regarded as novel and non-obvious.

What is claimed is:

1. A noise and vibration sensor arrangement configured to operate with an active road noise control system, the arrangement comprising:

an energy harvester configured to obtain electrical energy from an ambient energy source;

an acceleration sensor supplied with the electrical energy from the energy harvester and configured to generate a sense signal representative of at least one of accelerations, motions and vibrations that act on the acceleration sensor;

a signal processor supplied with the electrical energy from the energy harvester and configured to process the sense signal and to provide a processed sense signal, the signal processor having a normal mode of operation with a first energy consumption and an energy saving mode of operation with a second energy consumption that is lower than the first energy consumption;

a signal transmitter supplied with electrical energy from the energy harvester and configured to wirelessly broadcast the processed sense signal, the signal transmitter having a normal mode of operation with a third energy consumption and an energy saving mode of operation with a fourth energy consumption that is lower than the third energy consumption; and an energy controller configured to evaluate the electrical energy from the energy harvester and to control at least one of the signal processor and the signal transmitter to operate in the energy saving mode when the electrical energy from the energy harvester is below a predetermined energy level and to otherwise operate in the normal mode, wherein the signal processor is further configured to process the sense signal in the energy saving mode with the second energy consumption.

2. The arrangement of claim 1, wherein at least one of the signal processor and the signal transmitter is configured to process and/or transmit digital signals with a first data rate in the normal mode and a second data rate in the energy saving mode, the first data rate being higher than the second data rate.

3. The arrangement of claim 2, wherein the digital signals include a first sampling rate in the normal mode of operation and a second sampling rate in the energy saving mode of operation, the first sampling rate being greater than the second sampling rate.

4. The arrangement of claim 2, wherein the digital signals have a first digital word size in the normal mode and a second digital word size in the energy saving mode, the first digital word size being greater than the second digital word size.

5. The arrangement of claim 1, wherein the energy harvester comprises a temporary energy storage that is configured to store electrical energy when the energy harvester obtains more electrical energy than is supplied to the acceleration sensor, the signal processor and the signal transmitter, and to provide additional electrical energy when the energy harvester obtains less electrical energy than is supplied to the acceleration sensor, signal processor and signal transmitter.

6. The arrangement of claim 1, wherein the energy harvester comprises an energy harvester transducer configured to convert mechanical energy into electrical energy that is supplied to the acceleration sensor, the signal processor and the signal transmitter.

7. The arrangement of claim 1, wherein the at least one of the signal processor and the signal transmitter further comprises an advanced energy saving mode of operation with an energy consumption that is lower than the energy consumption in the respective energy saving mode of operation; and the energy controller is further configured to control the at least one of the signal processor and the signal transmitter to operate in the advanced energy saving mode when the electrical energy from the energy harvester is below a further predetermined energy level.

8. An active road noise control system comprising the noise and vibration sensor arrangement according to claim 1, an active road noise control module and at least one loudspeaker.

9. A noise and vibration sensing method configured to operate with an active road noise control system, the method comprising:

obtaining electrical energy from an ambient energy source;

supplying an acceleration sensor with the electrical energy from an energy harvester;

generating with the acceleration sensor a sense signal representative of at least one of accelerations, motions and vibrations that act on the acceleration sensor;

supplying a signal processor with the electrical energy from the energy harvester, the signal processor having a normal mode of operation with a first energy consumption and an energy saving mode of operation with a second energy consumption that is lower than the first energy consumption;

processing the sense signal to provide a processed sense signal;

supplying a signal transmitter with the electrical energy from the energy harvester, the signal transmitter having a normal mode of operation with a third energy consumption and an energy saving mode of operation with a fourth energy consumption that is lower than the third energy consumption;

wirelessly broadcasting the sense signal via the signal transmitter;

evaluating the electrical energy obtained from the ambient energy source; and controlling at least one of the signal processor and the signal transmitter to operate in the energy saving mode when the electrical energy from the energy harvester is below a predetermined energy level and to otherwise operate in the normal mode, wherein processing the sense signal to provide the processed sense signal further includes processing the sense signal in the energy saving mode with the second energy consumption.

10. The method of claim 9, wherein at least one of the signal processor and the signal transmitter processes and/or transmits digital signals at a first data rate in the normal mode and at a second data rate in the energy saving mode, the first data rate being higher than the second data rate.

11. The method of claim 10, wherein the digital signals have a first sampling rate in the normal mode and a second sampling rate in the energy saving mode, the first sampling rate being greater than the second sampling rate.

12. The method of claim 10, wherein the digital signals have a first digital word size in the normal mode and a second digital word size in the energy saving mode, the first digital word size being greater than the second digital word size.

13. The method of claim 9, further comprising storing the electrical energy when more electrical energy is obtained than is supplied to the acceleration sensor, the signal processor, and the signal transmitter; and providing additional electrical energy when less electrical energy is obtained than is supplied to the acceleration sensor, the signal processor and the signal transmitter.

14. The method of claim 9, wherein obtaining the electrical energy from the ambient energy source includes converting mechanical energy into electrical energy.

15. The method of claim 9, wherein the at least one of the signal processor and the signal transmitter further comprises an advanced energy saving mode of operation with an energy consumption that is lower than the energy consumption in the respective energy saving mode of operation; and the method further comprises controlling the at least one of the signal processor and the signal transmitter to operate in the advanced energy saving mode when the electrical energy from the energy harvester is below a further predetermined energy level.

16. A noise and vibration sensor arrangement configured to operate with an active road noise control system, the arrangement comprising:

an energy harvester configured to obtain electrical energy from an ambient energy source;

an acceleration sensor configured to generate a sense signal indicative of at least one of accelerations, motions and vibrations that act on the acceleration sensor;

a signal processor configured to receive the sense signal and to provide a processed sense signal, the signal processor including a normal mode of operation with a first energy consumption and an energy saving mode of operation with a second energy consumption, the first energy consumption being greater than the second energy consumption;

a signal transmitter configured to wirelessly broadcast the processed sense signal, the signal transmitter including a normal mode of operation with a third energy consumption and an energy saving mode of operation with a fourth energy consumption that is lower than the third energy consumption; and an energy controller configured to evaluate the electrical energy from the energy harvester and to control at least one of the signal processor and the signal transmitter to operate in the energy saving mode when the electrical energy is below a predetermined energy level and to operate in the normal mode when the electrical energy is above the predetermined energy level, wherein the signal processor is further configured to process the sense signal in the energy saving mode with the second energy consumption.

17. The arrangement of claim 16, wherein at least one of the signal processor and the signal transmitter is configured to process and/or transmit digital signals with a first data rate in the normal mode and a second data rate in the energy saving mode, the first data rate being higher than the second data rate.

18. The arrangement of claim 17, wherein the digital signals include a first sampling rate in the normal mode and a second sampling rate in the energy saving mode, the first sampling rate being greater than the second sampling rate.

19. The arrangement of claim 16, wherein the energy harvester comprises an energy harvester transducer configured to convert mechanical energy into electrical energy that is supplied to the acceleration sensor, the signal processor and the signal transmitter.

20. The arrangement of claim 16, wherein:

the at least one of the signal processor and the signal transmitter further comprises an advanced energy saving mode of operation with an energy consumption that is lower than the energy consumption in the respective energy saving mode of operation; and the energy controller is further configured to control the at least one of the signal processor and the signal transmitter to operate in the advanced energy saving mode when the electrical energy from the harvester is below a further predetermined energy level.

* * * * *